US007204240B2

(12) United States Patent
Malone et al.

(10) Patent No.: US 7,204,240 B2
(45) Date of Patent: Apr. 17, 2007

(54) INTEGRATED VALVE

(75) Inventors: Jeffrey A. Malone, Holly, MI (US); Murray Busato, Clinton Township, MI (US); Joseph A. Wilson, Royal Oak, MI (US); Peter G. Weissinger, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/144,909

(22) Filed: Jun. 3, 2005

(65) Prior Publication Data

US 2005/0274367 A1 Dec. 15, 2005

Related U.S. Application Data

(60) Provisional application No. 60/578,981, filed on Jun. 12, 2004.

(51) Int. Cl.
*F02M 25/07* (2006.01)
*F02M 25/00* (2006.01)

(52) U.S. Cl. ..... 123/568.17; 123/568.18

(58) Field of Classification Search ..... 123/568.17, 123/568.18, 184.21, 568.23, 306, 308
See application file for complete search history.

(56) References Cited

U.S. PATENT DOCUMENTS

| | | | | |
|---|---|---|---|---|
| 3,507,260 | A | 4/1970 | Walker | |
| RE27,993 | E | 4/1974 | Walker | |
| 4,693,226 | A * | 9/1987 | Choma | 123/568.17 |
| 5,785,034 | A | 7/1998 | Moedinger et al. | |
| 5,957,116 | A | 9/1999 | Haegele et al. | |
| 6,070,852 | A * | 6/2000 | McDonnell et al. | 251/129.11 |
| 6,073,617 | A | 6/2000 | Busato et al. | |
| 6,152,115 | A | 11/2000 | Busato et al. | |
| 6,311,677 | B1 | 11/2001 | Cook et al. | |
| 6,422,221 | B2 | 7/2002 | Pietrowski et al. | |
| 6,435,169 | B1 * | 8/2002 | Vogt | 123/568.23 |
| 6,513,507 | B2 * | 2/2003 | Balekai et al. | 123/568.17 |
| 6,748,935 | B2 | 6/2004 | Brosseau et al. | |
| 6,758,196 | B2 | 7/2004 | Brosseau et al. | |
| 6,772,729 | B2 | 8/2004 | Brosseau et al. | |
| 6,776,146 | B1 | 8/2004 | Ricart-Ugaz et al. | |
| 6,848,432 | B2 * | 2/2005 | Veinotte et al. | 123/520 |
| 2002/0023630 | A1 | 2/2002 | Balekai et al. | |
| 2004/0079347 | A1 | 4/2004 | Bender et al. | |

* cited by examiner

*Primary Examiner*—Mahmoud Gimie
(74) *Attorney, Agent, or Firm*—Warn, Hoffman, Miller & Ozga, P.C.; Greg Dziegielewski

(57) ABSTRACT

An exhaust gas recirculation (EGR) arrangement having an intake manifold with a valve base assembly integrated with the engine's intake manifold. The valve base assembly has a valve seat positioned in the path of fluid flow through the valve base. A valve member is also contained in the valve base and is operably disposed in relation to the valve seat. An actuator is connectable with the valve base and with the valve member to open and close the valve seat in response to actuation of the actuator. The actuator can disconnect from the valve base and valve member.

20 Claims, 4 Drawing Sheets

INTEGRATED VALVE

CROSS-REFERENCE TO RELATED APPLICATIONS

This application claims the benefit of U.S. Provisional Application No. 60/578,981, filed Jun. 12, 2004. The disclosure of which is incorporated herein by reference.

FIELD OF THE INVENTION

The present invention relates to an exhaust gas recirculation valve that is integrated with an intake manifold.

BACKGROUND OF THE INVENTION

Federal and State legislation require control of vehicle exhaust emissions. Oxides of nitrogen (NOx) are one of the exhaust gas emissions that must be controlled. Formation of NOx will occur at higher combustion temperatures. In order to reduce the occurrence of the formation of NOx gases, exhaust gas recirculation systems have been developed which effectively reduce combustion temperatures and control emissions. Exhaust gas recirculation systems work by recirculating a portion of the exhaust gas from an engine back to the intake manifold where it can be combined with incoming air. When the mixture is compressed and ignited in the cylinder the result is a lower combustion temperature and the reduction of NOx. In order to make the recirculation of exhaust gas possible exhaust gas recirculation systems use exhaust gas recirculation (EGR) valves to open and close the conduits that recirculate the exhaust gas back to the intake manifold of the engine.

FIG. 1 is a cross-sectional view of a conventional EGR valve assembly having a valve body and actuator portion that are separate from the intake manifold. As shown, an actuator/valve assembly 1 has a valve body 2 and an actuator housing 3 connected together. The actuator housing 3 has an electrical connecter 4 that supplies energy to a motor 5 and a position sensor 6. The actuator housing 3 is aligned and connected to the valve body 2 using fasteners 7 and alignment pins 56. A seal 8 such as a paper-metal gasket is disposed between the valve body 2 and the actuator housing 3 in order to protect the actuator/valve assembly 1 from the outside environment and limit thermal transfer between the valve body 2 and housing 3. The EGR valve is then connected in some fashion to conduits that lead to the intake manifold of an engine. Sometimes the EGR valve body itself is bolted onto the intake manifold.

The use of EGR valves decreases the amount of space available in an engine because the EGR valve is another component that must be connected to an engine compartment. Therefore, it is desirable to develop EGR valves that take up minimal space. Additionally, it is also desirable to be able to remove the actuator portion of the EGR valve from the valve body in a manner will allow valve components to remain in their respective positions while allowing the actuator and actuator related components to be removed. This provides ease of servicing the actuator portion of the EGR valve. Additionally, it also provides an easy way of accessing the components of the valve body. Additionally there are manufacturing benefits to having an actuator portion that can be easily connected to or detached from the valve portion and its respective components.

SUMMARY OF THE INVENTION

The present invention relates to an exhaust gas recirculation (EGR) arrangement having an intake manifold with a valve base assembly integrated with the engine's intake manifold. The valve base assembly has a valve seat positioned in the path of fluid flow through the valve base. A valve member is also contained in the valve base and is operably disposed in relation to the valve seat. An actuator is connectable with the valve base and has a fork connectable with the valve member to open and close the valve seat in response to actuation of the actuator. The actuator and the fork can disconnect from the valve base and valve member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
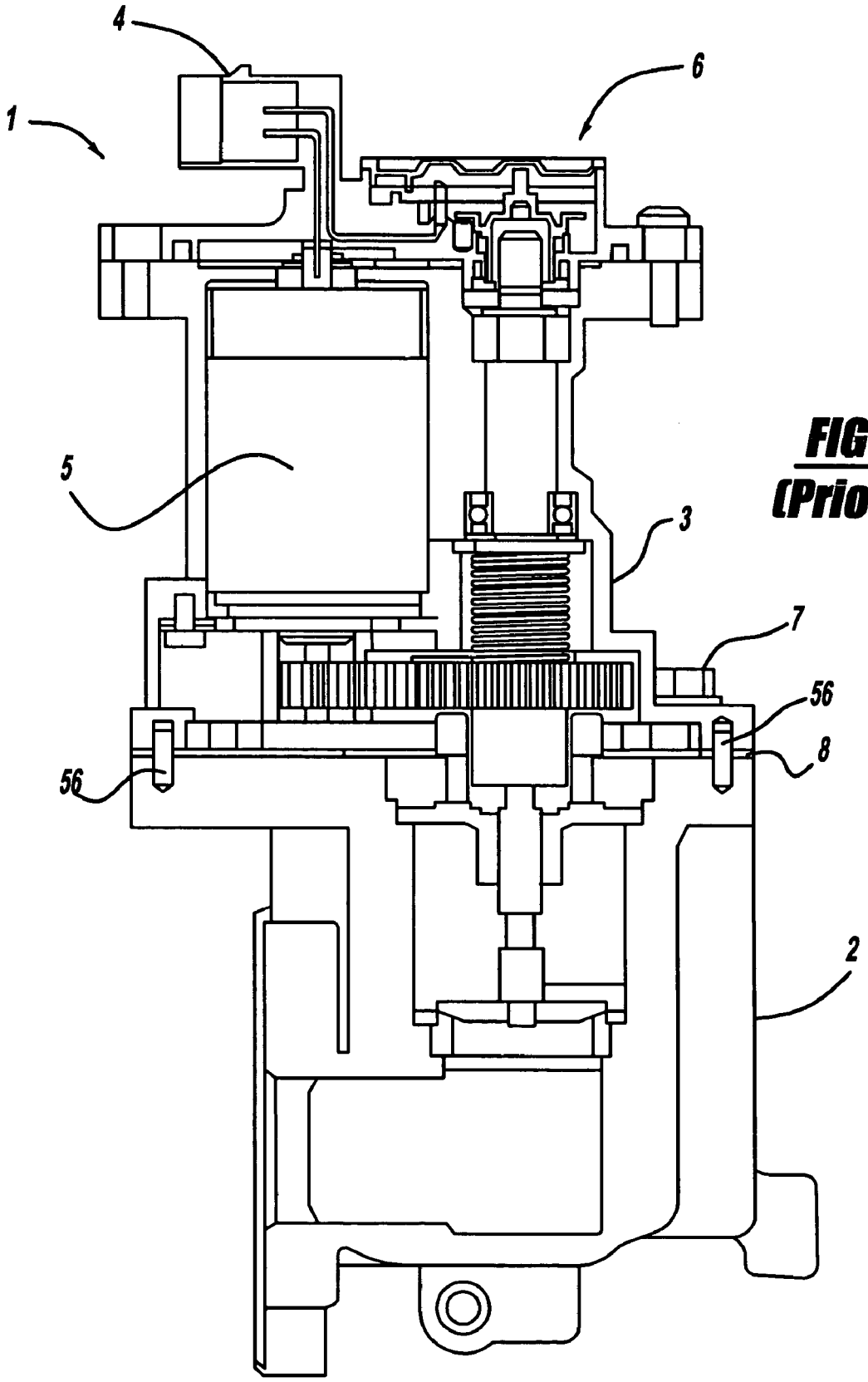
FIG - 1 (Prior Art)
FIG. 1 is a cross-sectional plan view of conventional EGR valve.
Figure 2:
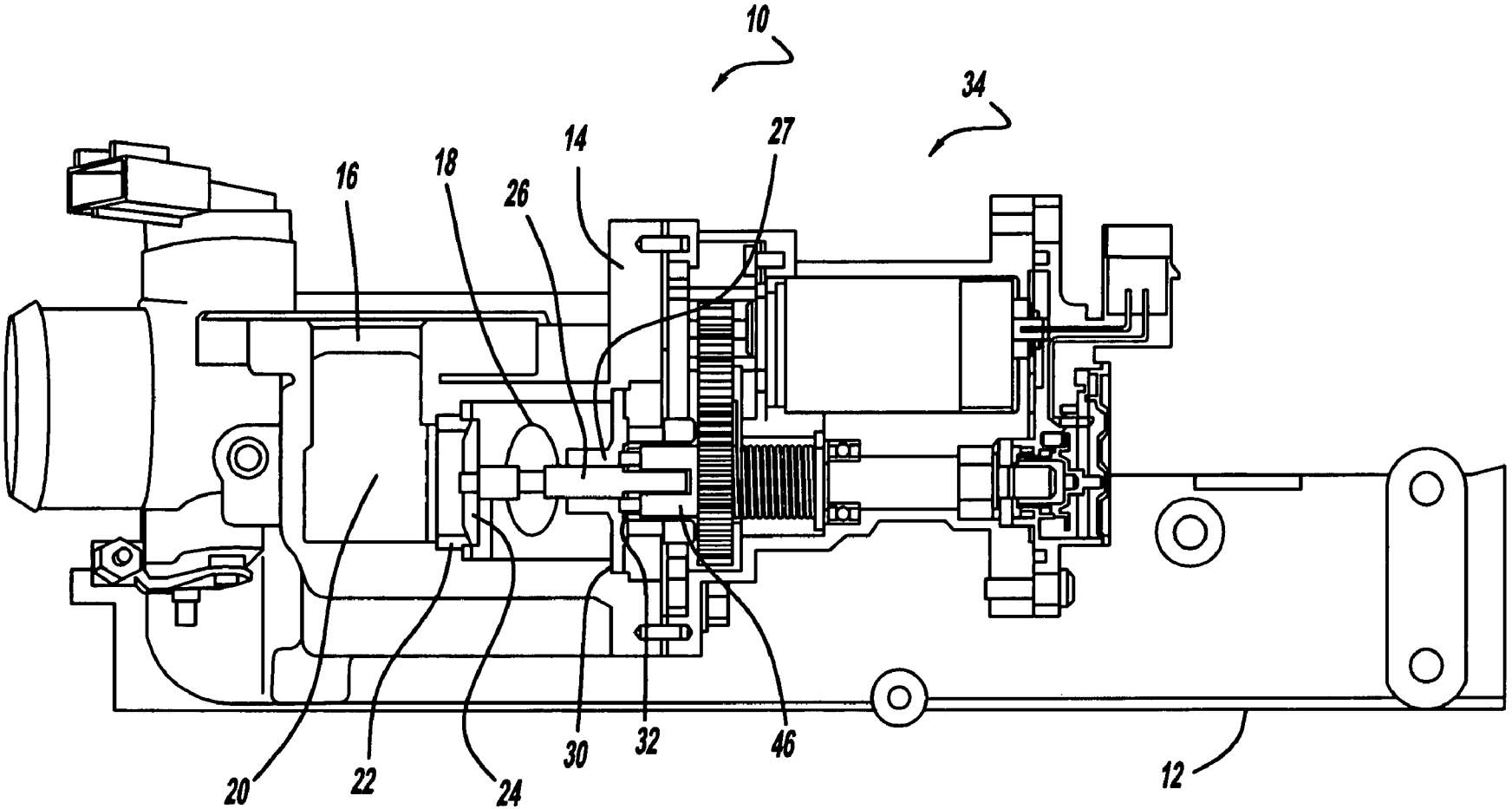
FIG. 2 is a cross-sectional plan view of an EGR arrangement connected to an intake manifold.
Figure 3:
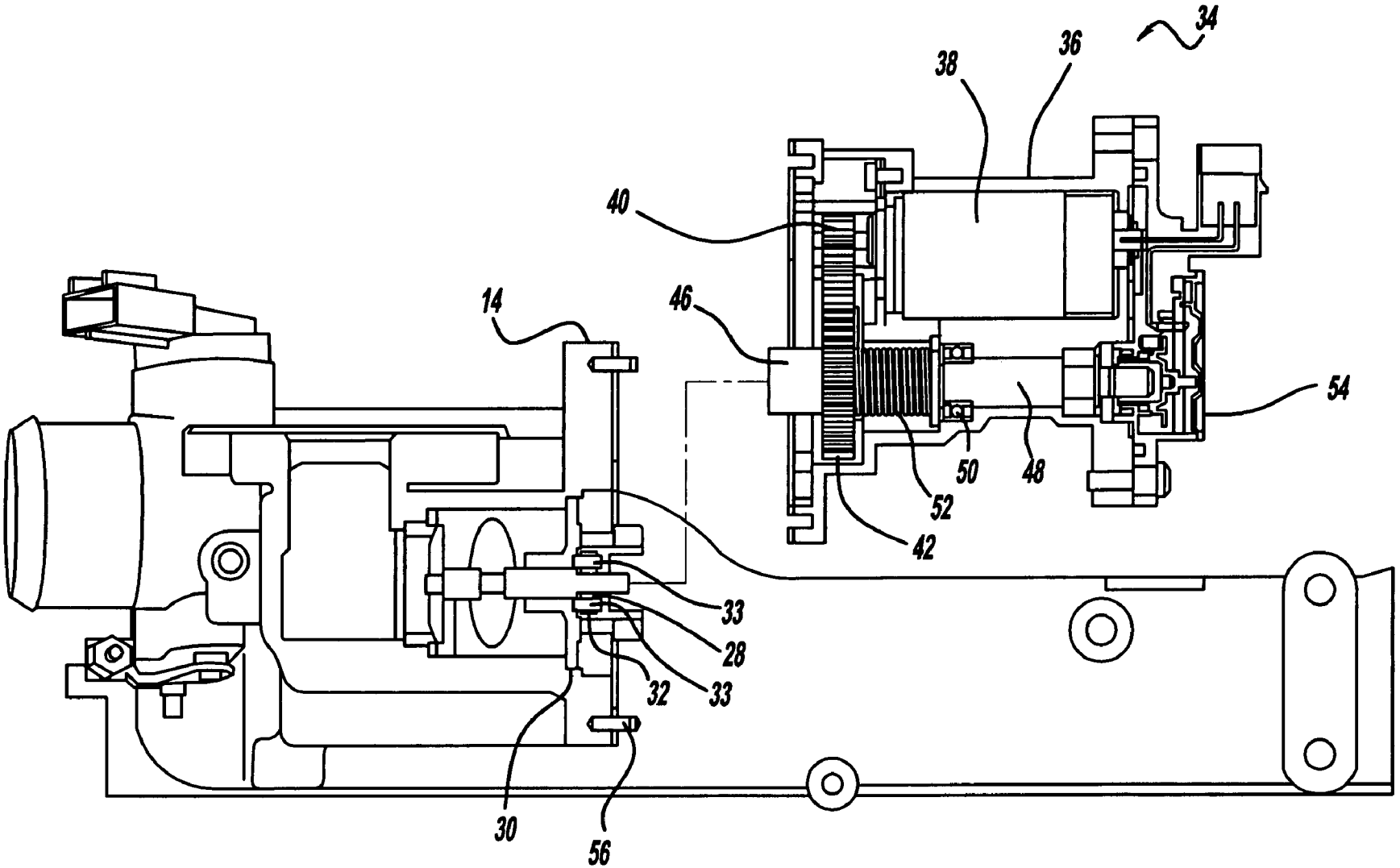
FIG. 3 is a cross-sectional plan view of an EGR valve connected to an intake manifold, wherein the valve base portion is separated from the actuator portion.

FIGS. 2 and 3 depict a cross-sectional view of an EGR valve arrangement 10 integrated with an intake manifold 12 in accordance with the present invention. A valve base assembly 14 is integrated to the intake manifold 12. The valve base assembly 14 has an input passage 16 and an output passage 18. The input passage 16 receives exhaust gas from the exhaust manifold (not shown) and directs it to the output 18 via a fluid passage 20 through the valve base assembly 14. The output 18 directs recirculating exhaust gas to the intake manifold 12. A valve seat 22 is disposed in the fluid passage 20 so that fluid moving from the input 16 to the output 18 will pass through the valve seat 22.

A valve member 24 is operably disposed in relation to the valve seat 22 and functions to open and close the fluid passage 20 by seating and unseating against the valve seat 22. The valve member 24 is connected at a first end to a valve shaft 26. The valve shaft 26 extends through a bushing 27 and a pin 28 located at the second end of the valve shaft 26. A bearing guide 30 is disposed about the second end of the valve shaft 26. The bearing guide 30 has slotted guide ramps 32 which the end of the pin 28 slidingly engage. The ends of the pin 28 can also have roller or ball bearings 33 that help to facilitate the sliding movement of the pin 28 on the slotted guide ramps 32. The effective slope of the slotted guide ramps 32 will, in part, determine the operating force of the EGR valve. The slope can be varied through the rotation to provide a variable flow rate through the axial stroke. The slope can also control the operating force, at a specific rotation/stroke.

An actuator portion 34 is operably connected to the valve base assembly 14. The actuator 34 has a housing 36 that contains a motor 38. The motor 38 can be virtually any type of suitable actuator. In this particular embodiment of the invention, the motor 38 is a multi-turn DC motor. The motor 38 is connected to and drives an interface gear 40. The interface gear 40 is splined with a fork gear 42, so that when the interface gear 40 rotates it will cause the fork gear 42 to rotate. The fork gear 42 has a fork member 46 that is integrally formed into the fork gear 42. The fork gear 42 is connected to a shaft 48 that provides an axis for rotating the fork gear 42. The shaft 48 is disposed through bearings 50 that allow for the rotation of the shaft 48. A spring member 52 is positioned between the bearings 50 and the fork gear 42 which functions to hold the fork gear 42 in place and keep it in splined connection with the interface gear 40.

A position sensor 54 is located at the end of the shaft 48. The position sensor 54 functions to sense the position of the fork gear 42 and ultimately the position of the valve member 24. The actuator housing 36 is connected to the valve base assembly 14 by suitable fasteners 7 such as screws or bolts.

The actuator 34 operably engages the components of the valve base assembly 14 through the fork member 46. The fork member 46 engages the pin 28 and the rotation of the fork 46 causes the pin 28 to rotate in the bearing guide 30. As the fork 46 rotates the end of the pin 28 will slide along the slotted guide ramps 32 of the bearing guide 30. This in turn causes the valve shaft 26 to rotate away from or toward the valve seat 22 depending on the rotation of the fork gear 42. Although this particular embodiment of the invention describes a fork 46 as being the portion that operably connects the actuator 34 to the valve base assembly 14, it is within the scope of this invention that the fork 46 could be substituted with virtually any type of mechanism that would cause the valve shaft 26 to move between the open and closed positions. Thus the use of a bearing guide with slotted guide ramps and a valve shaft with a pin member is not intended to any way limit the scope of this invention.

Figure 4:
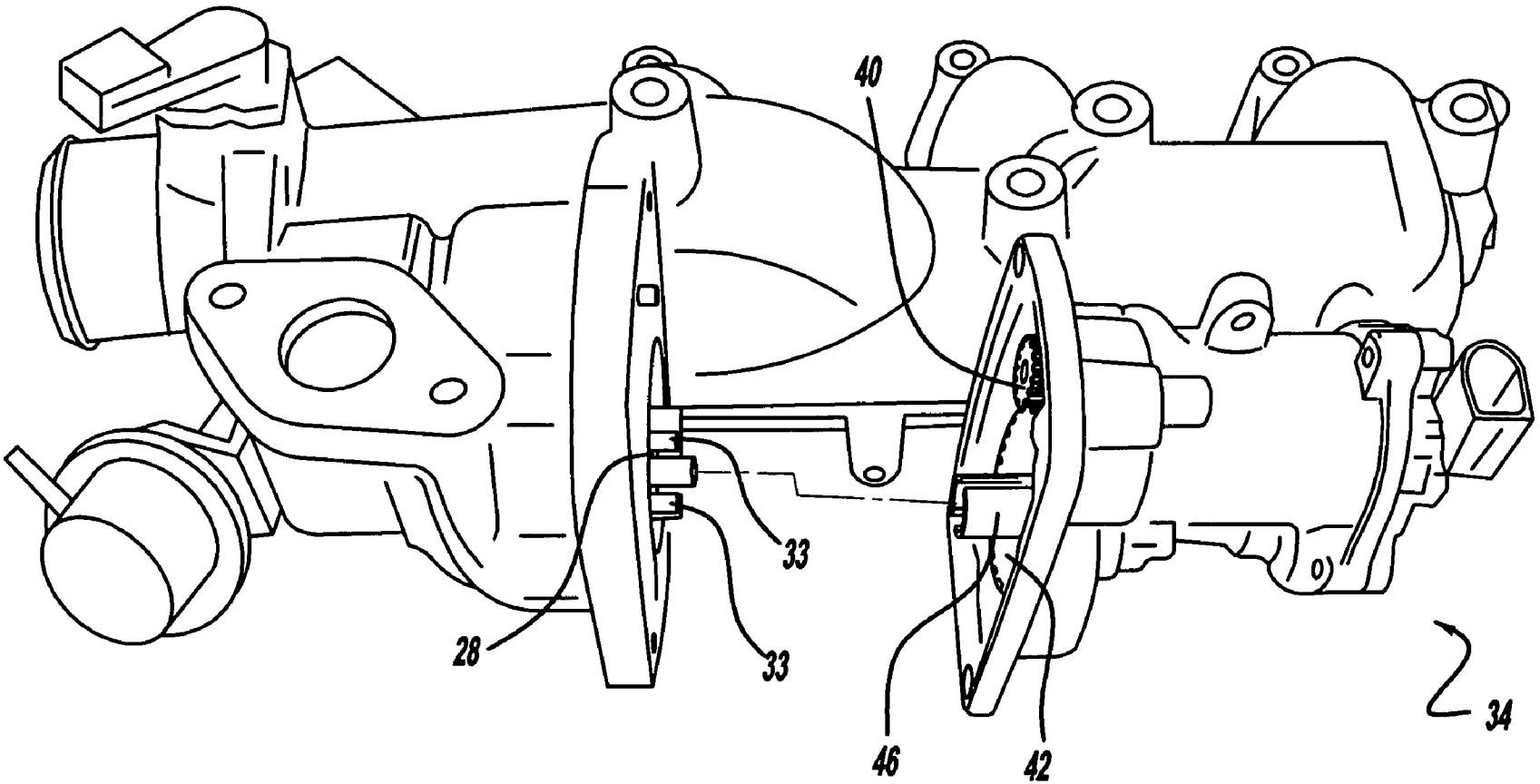
FIG. 4 is a perspective view of the actuator portion separated from the valve base portion.

FIGS. 3 and 4 show the actuator 34 disconnected from the valve base assembly 14. The actuator 34 can be removed by removing the fasteners 7 which disconnects the housing 36 of the actuator 34 from the valve base assembly 14. When the housing 36 is removed all of the components of the actuator 34 disconnect from the components of the valve base assembly 14. This provides many advantages. First it allows for easy access to the actuator or the components of the valve base assembly 14 for repair. Additionally it also aids in the ease of assembly during the manufacturing process since the actuator 34 can easily be connected with the valve base assembly 14. The present embodiment of the invention also provides an advantage in that integrating the valve base assembly 14 into the intake manifold 12 saves space in the engine design. When the actuator 34 is removed from the valve base assembly 14 the fork gear 42 disengages from the pin 28 so that the components of the valve base assembly remain in tack or easily accessible for service or repair. Likewise the actuator 34 has now been disconnected so that its mechanical components such as the motor 38, interface gear 40 and fork gear 42 can be removed or replaced for repair purposes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An Exhaust Gas Recirculation (EGR) arrangement comprising:

an intake manifold;

a valve base assembly integrated with said intake manifold, wherein said valve base has a valve seat and a valve member operably disposed in relation to said valve seat; and an actuator connectable with said valve base, said actuator is connectable with said valve member for causing said valve member to open and close in relation to the valve seat in response to actuation of said actuator, wherein said actuator can disconnect from said valve base and said valve member.

2. The valve arrangement of claim 1 wherein the actuator is connectable with the valve member by a fork.

3. The arrangement of claim 2 wherein said valve base comprises:

a valve shaft connected at one end to said valve member;

a pin disposed through a second end of said valve shaft;

a bearing guide circumscribing said second end of said valve shaft and having opposing upwardly and downwardly sloped ramps, wherein the ends of said pin are configured to slide on said upwardly and downwardly sloped ramps; and wherein said fork contacts said pin to operably associate said actuator with said valve base.

4. The arrangement of claim 1 wherein said actuator further comprises:

a housing containing;

a motor operably connected to an interface gear;

a fork gear splined to said interface gear, wherein said fork gear has a gear portion and a fork integrally formed together;

a shaft connected to said fork gear, wherein said shaft provides an axis for said fork gear to rotate; and a position sensor disposed at the end of said shaft, wherein said position sensor senses the position of said fork gear.

5. The arrangement of claim 4 wherein said actuator can be completely detachable from said valve base including all components within said housing of said actuator.

6. The arrangement of claim 4 wherein said motor is a multi-turn DC motor.

7. The arrangement of claim 4 wherein an axis of said motor and an axis of said valve member are offset and parallel.

8. The arrangement of claim 1 wherein said valve member opens in a direction either away from said valve seat and toward said actuator, or away from said valve seat and away from said actuator.

9. An Exhaust Gas Recirculation (EGR) arrangement having an integrated valve, comprising:

an intake manifold;

a valve base assembly integrated with said intake manifold, wherein said valve base has a valve seat, a bushing, a valve shaft slidably disposed through said bushing, a valve member connected to an end of said valve shaft near said valve seat for operably engaging said valve seat; and an actuator connectable with said valve base, said actuator having a mechanism connectable with said valve shaft for causing said valve member to move between an open and closed position in relation to said valve seat in response to the actuation of said actuator, wherein said actuator and said mechanism can disconnect from said valve base and said valve shaft so that the components of the valve base remain in place when said actuator is removed.

10. The arrangement of claim 9 wherein said valve member is a poppet valve member.

11. The arrangement of claim 9 wherein said actuator further comprises:

a housing containing a motor operably connected to an interface gear;

a fork gear splined to said interface gear, wherein said fork gear has a gear portion and said mechanism formed together;

a shaft connected to said fork gear wherein said shaft provides an axis for said fork gear to rotate; and a position sensor disposed at the end of said shaft, wherein said position sensor senses the position of said fork gear.

12. The arrangement of claim 11 wherein an axis of said motor and an axis of said valve member and offset and parallel.

13. The arrangement of claim 9 wherein said valve member opens in a direction either away from said valve and toward said actuator, or away from said valve seat and away from said actuator.

14. The arrangement of claim 9 wherein said actuator can be completely detachable from said valve base including all components within said actuator.

15. An Exhaust Gas Recirculation (EGR) arrangement having an integrated valve comprising:

an intake manifold;

a valve base assembly integrated with said intake manifold, wherein said valve base assembly has a valve shaft connected at one end to said valve member, a pin disposed through a second end of said valve shaft, a bearing guide circumscribing said valve shaft and having opposing upwardly and downwardly sloped ramps, wherein said end of said pins are configured to slide on said upwardly downwardly sloped ramps; and an actuator connectable with said valve base, said actuator having a housing containing a motor operably connected to an interface gear, a fork gear splined to said interface gear, said fork gear having a gear portion and a fork integrally formed together, a shaft connected to said fork gear, wherein said shaft provides an axis for said fork gear to rotate, and a position sensor disposed at an end of said shaft, wherein said position sensor senses the position of said fork gear, wherein said actuator and said fork gear can disconnect from said valve base and said valve pin.

16. The Exhaust Gas Recirculation (EGR) system having an integrated valve of claim 15, wherein all mechanical components associated with said actuator have the ability to be detachable from said valve base assembly when said actuator is detached from said valve base assembly.

17. The Exhaust Gas Recirculation (EGR) arrangement of claim 15 wherein said motor is a multi-turn DC motor.

18. The Exhaust Gas Recirculation (EGR) arrangement of claim 15 wherein said valve member opens in a direction either away from said valve seat and towards said actuator, or away from said valve seat and away from said actuator.

19. The Exhaust Gas Recirculation (EGR) arrangement of claim 15 wherein said valve member is a poppet valve member.

20. An exhaust gas recirculation (EGR) arrangement comprising:

an intake manifold;

a valve base assembly integrated with said intake manifold, wherein said valve base has a valve seat and a valve member operably disposed in relation to said valve seat;

a valve shaft connected at one end to said valve member;

a pin disposed through a second end of said valve shaft;

a bearing guide comprising said second end of said valve shaft and having opposing upwardly and downwardly sloped ramps wherein the ends of said pin are configured to slide on said upwardly and downwardly sloped ramps; and an actuator connected with said valve base assembly, said actuator is connectable with said valve member;

a fork extending from said actuator and connectable with said pin to operably associate said actuator with said valve base, wherein said actuator and said fork can disconnect from said valve base and said valve member.

* * * * *